US008493270B2

(12) United States Patent
Hikino

(10) Patent No.: US 8,493,270 B2
(45) **Date of Patent: *Jul. 23, 2013**

(54) WIRELESS DEVICE

(75) Inventor: Nozomu Hikino, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 353 days.

This patent is subject to a terminal disclaimer.

(21) Appl. No.: 12/921,528

(22) PCT Filed: May 18, 2009

(86) PCT No.: PCT/JP2009/059134

§ 371 (c)(1),
(2), (4) Date: Sep. 8, 2010

(87) PCT Pub. No.: WO2009/154053

PCT Pub. Date: Dec. 23, 2009

(65) Prior Publication Data

US 2011/0018773 A1 Jan. 27, 2011

(30) Foreign Application Priority Data

Jun. 19, 2008 (JP) ..... 2008-160792

(51) Int. Cl.
*H01Q 1/24* (2006.01)

(52) U.S. Cl.
USPC ..... 343/702; 343/850; 343/852; 343/860; 455/575.7

(58) Field of Classification Search
USPC ..... 343/702, 850, 852, 860; 455/575.1, 455/575.7
See application file for complete search history.

(56) References Cited

U.S. PATENT DOCUMENTS

2004/0219956 A1 11/2004 Iwai et al.
2004/0227673 A1 11/2004 Iwai et al.

(Continued)

FOREIGN PATENT DOCUMENTS

CN 1833145 A 6/2005
CN 1703895 A 11/2005

(Continued)

OTHER PUBLICATIONS

US Office Action for U.S. Appl. No. 12/920,541 dated Sep. 20, 2012.

*Primary Examiner* — Dieu H Duong
(74) *Attorney, Agent, or Firm* — Birch, Stewart, Kolasch & Birch, LLP

(57) ABSTRACT

A wireless device, including an antenna different from another antenna included in one of two casings, in a joint part where the two casings are joined together, is capable of reducing deterioration in properties of the antenna included in the joint part. The wireless device (1) of the present invention includes: an upper casing (10), housing a casing antenna (11) that resonates with a first frequency; a lower casing (20), housing a matching circuit (23) of the casing antenna (11); a hinge part (31), joining the upper casing (10) with the lower casing (20), including a built-in antenna (32) that resonates with a second frequency different from the first frequency, and including feeding sections (33) and (34) for coupling the matching circuit (23) to the casing antenna (11); and transmission elements (12) and (22), being disposed on at least any one of a signal path that connects the casing antenna (11) and the feeding section (33) and a signal path that connects the matching circuit (23) and the feeding section (34), the transmission elements (12) and (22) (i) giving passage to a signal having the first frequency and (ii) blocking a signal having the second frequency.

10 Claims, 15 Drawing Sheets

U.S. PATENT DOCUMENTS

| | | | | |
|---|---|---|---|---|
| 2004/0253972 | A1 | 12/2004 | Iwai et al. | |
| 2005/0001773 | A1 | 1/2005 | Morningstar et al. | |
| 2005/0239519 | A1 | 10/2005 | Saitou et al. | |
| 2006/0071863 | A1 | 4/2006 | Lindell | |
| 2006/0097927 | A1 | 5/2006 | Satoh et al. | |
| 2006/0109185 | A1 | 5/2006 | Iwai et al. | |
| 2006/0293097 | A1 | 12/2006 | Shimizu et al. | |
| 2007/0105602 | A1 | 5/2007 | Takebe | |
| 2007/0210970 | A1 | 9/2007 | Egawa et al. | |
| 2007/0225053 | A1 | 9/2007 | Iwai et al. | |
| 2008/0300028 | A1 | 12/2008 | Uejima et al. | |
| 2009/0128424 | A1 | 5/2009 | Suzuki et al. | |
| 2009/0176541 | A1 | 7/2009 | Okajima | |
| 2009/0233657 | A1 | 9/2009 | Ogawa | |
| 2011/0001674 | A1 * | 1/2011 | Hikino | 343/702 |

FOREIGN PATENT DOCUMENTS

| | | | |
|---|---|---|---|
| CN | 101164323 | A | 4/2008 |
| EP | 2 023 437 | A1 | 2/2009 |
| JP | 10-308618 | A | 11/1998 |
| JP | 2002-217755 | A | 8/2002 |
| JP | 2004-229048 | A | 8/2004 |
| JP | 2004-274729 | A | 9/2004 |
| JP | 2005-328316 | A | 11/2005 |
| JP | 2006-54843 | A | 2/2006 |
| JP | 2006-67133 | A | 3/2006 |
| JP | 2006-508624 | A | 3/2006 |
| JP | 2006-514508 | A | 4/2006 |
| JP | 2006-157787 | A | 6/2006 |
| JP | 2008-72204 | A | 3/2008 |
| WO | WO 02/03665 | A1 | 1/2002 |
| WO | WO 2005/053089 | A1 | 6/2005 |
| WO | WO 2005/086363 | A1 | 9/2005 |
| WO | WO 2006/013659 | A1 | 2/2006 |
| WO | WO 2006/022331 | A1 | 3/2006 |
| WO | WO 2007/032330 | A1 | 3/2007 |
| WO | WO 2007/138682 | A1 | 12/2007 |
| WO | WO 2008/004479 | A1 | 1/2008 |

* cited by examiner

CONNECTION EXAMPLE a

CONNECTION EXAMPLE b

CONNECTION EXAMPLE c

CONNECTION EXAMPLE d

CONNECTION EXAMPLE e

FIG. 4

| CONNECTION EXAMPLE | ELEMENT CONFIGURATION | | |
|---|---|---|---|
| | ELEMENT A | ELEMENT B | ELEMENT C |
| a | L | C | — |
| b | L | C | L |
| | L | C | C |
| c | L | C | L |
| | L | C | C |
| d | L | C | C |
| | C | L | L |
| e | L | L | C |
| | C | C | L |

WIRELESS DEVICE

TECHNICAL FIELD

The present invention relates to a wireless device including two antennas that use different frequencies from each other.

BACKGROUND ART

Recently, mobile phones are often used as a type of wireless device, and mobile phones of various configurations have been developed. Among such mobile phones, foldable phones are well known, which include upper and lower casings, and in which ends of the upper and the lower casings are connected to each other as a hinge part.

For example, as shown in FIGS. 11(*a*) and 11(*b*), Patent Literature 1 discloses a wireless device in which an upper casing 301 is connected to a lower casing 302 by use of a hinge 303. More specifically, in the wireless device disclosed in Patent Literature 1, the upper casing 301 includes a substrate 304 and a conductor that serves as an antenna element. The conductor is connected, via a feeding section 307, to a matching circuit 309 included in the lower casing 302. Further, the lower casing 302 has a radio unit circuit 310 provided on a substrate 305. The radio unit circuit 310 processes a high-frequency signal having a frequency with which the antenna element resonates.

As another conventional example of the foldable wireless device as disclosed in Patent Literature 1, a wireless device including two antennas that use different frequencies is also well known. Such a wireless device having two antennas has many advantages, such as that the wireless device can utilize a plurality of communication systems that have different frequencies, or that the wireless device can perform both utilization of the communication system and reception of airwaves. For example, the wireless device can perform wireless communication in accordance with a WCDMA (Wideband Code Division Multiple Access: 2 GHz) band by use of one of the two antennas, and perform reception of television airwaves in accordance with an UHF (Ultra High Frequency: 470 MHz to 770 MHz) band by use of the other one of the two antennas.

CITATION LIST

Patent Literature

Patent Literature 1
Japanese Patent Application Publication, Tokukai, No. 2006-54843 A (Publication Date: Feb. 23, 2006)

SUMMARY OF INVENTION

Technical Problem

With a wireless device including two antennas, in a case where one of the antennas is included in an upper casing and the other one of the antennas is included in a hinge part that includes ends of the upper casing and the lower casing, antenna properties of the antenna included in the hinge part (hereinafter referred to as a built-in antenna) deteriorate. The following description deals with this problem.

As in the wireless device disclosed in Patent Literature 1, in a case where a wireless device includes an antenna in an upper casing and includes a matching circuit of the antenna in a lower casing, a feeding section that couples the antenna (hereinafter referred to as a casing antenna) included in the upper casing to the matching circuit of the casing antenna, is provided in the hinge part. Therefore, by having the built-in antenna provided in the hinge part, the built-in antenna and the feeding section are disposed close to each other. Further, the casing antenna is a conductive pattern, and also serves as a ground pattern of the upper casing. It is conventionally known that, in a case where an antenna is disposed in the vicinity of a ground, the ground causes deterioration in properties of the antenna.

That is, the feeding section disposed close to the built-in antenna is connected to the casing antenna that serves as the ground pattern of the upper casing; this causes the ground to be disposed close to the built-in antenna. As a result, the feeding section causes deterioration in the antenna properties of the built-in antenna.

Further, the feeding section is connected to a ground pattern of the lower casing via the matching circuit of the casing antenna. This causes the ground to be disposed close to the built-in antenna. As a result, the feeding section causes further deterioration in the antenna properties of the built-in antenna.

The present invention is accomplished in view of the problem, and an object of the present invention is to provide a wireless device including an antenna in one of two casings, and including, in a joint part where the two casings are joined together, another antenna different from the antenna included in the casing, which wireless device is capable of reducing deterioration in properties of the antenna included in the joint part.

Solution to Problem

A wireless device of the present invention, in order to attain the object, includes a first casing, housing a first antenna that resonates with a first frequency; a second casing, housing a matching section for matching impedance with that of the first antenna; a joint part, joining the first casing with the second casing, the joint part including a second antenna that resonates with a second frequency different from the first frequency and including a coupling section for electrically coupling the matching section to the first antenna; and a first-frequency transmission element, being disposed on at least any one of a signal path that connects the first antenna and the coupling section and a signal path that connects the matching section and the coupling section, the first-frequency transmission element (i) giving passage to a signal having the first frequency and (ii) blocking a signal having the second frequency.

According to the foregoing structure, a first antenna is coupled to a matching section by a coupling section included in a joint part, and a second antenna is disposed in the joint part. The first antenna is connected to a ground of an upper casing so as to serve as an antenna. Further, the first antenna itself serves as a ground pattern of the upper casing with respect to the second antenna. Furthermore, the matching section for matching impedance with that of the first antenna is connected to a ground of a lower casing. Therefore, the coupling section is connected to two grounds: the ground of the upper casing and the ground of the lower casing.

The wireless device of the present invention has a first-frequency transmission element disposed on any one of (i) a signal path that connects the first antenna and the coupling section and (ii) a signal path that connects the coupling section and the matching section. This first-frequency transmission element blocks a signal having the second frequency with which the second antenna resonates. As a result, the ground around the second antenna is reduced, thereby increasing electrical volume of the second antenna.

For example, in the case where the wireless device has the first-frequency transmission element disposed on the signal path that connects the first antenna and the coupling section, the signal having the second frequency with which the second antenna resonates is not transmitted via the coupling section to the first antenna that is the ground of the upper casing, but is blocked by the first-frequency transmission element. That is, in a second frequency component, the coupling section is disconnected from the ground of the upper casing. Therefore, just the ground of the lower casing is connected to the coupling section. As a result, the coupling section disposed close to the second antenna less serves as a ground, thereby increasing the electrical volume of the second antenna.

Similarly, in the case where the wireless device has the first-frequency transmission element disposed on the signal path that connects the matching section and the coupling section, the coupling section is disconnected from the ground of the lower casing, in the second frequency component. As a result, the coupling section disposed close to the second antenna less serves as a ground, thereby increasing the electrical volume of the second antenna.

Further, in the case where the wireless device has the first-frequency transmission element disposed on both the signal path that connects the first antenna and the coupling section and the signal path that connects the coupling section and the matching section, the coupling section has no connection with the grounds in the second frequency component. As a result, the coupling section disposed close to the second antenna does not serve as a ground at all, thereby causing the electrical volume of the second antenna to be maximized.

The first-frequency transmission element has such a property that the first-frequency transmission element gives passage to the signal having the first frequency with which the first antenna resonates. Therefore, no deterioration occurs to properties of the first antenna, by including the first-frequency transmission element in the wireless device.

As described above, even if both the second antenna and the coupling section are disposed in the joint part, and the second antenna and the coupling section are disposed close to each other, the wireless device of the present invention makes the coupling section disposed close to the second antenna less serve as the ground of the second antenna, and causes the electrical volume of the second antenna to increase. As a result, deterioration in the second antenna properties is reduced, which deterioration is caused by a conductor that serves as a ground being disposed close to the second antenna.

Accordingly, the wireless device of the present invention includes an antenna in one of two casings, and includes, in a joint part where the two casings are joined together, another antenna different from the antenna included in the casing, and thus can reduce deterioration in properties of the antenna included in the joint part.

Advantageous Effects of Invention

As described above, the wireless device of the present invention includes a first casing, housing a first antenna that resonates with a first frequency; a second casing, housing a matching section for matching impedance with that of the first antenna; a joint part, joining the first casing with the second casing, the joint part including a second antenna that resonates with a second frequency different from the first frequency and including a coupling section for electrically coupling the matching section to the first antenna; and a first-frequency transmission element, being disposed on at least any one of a signal path that connects the first antenna and the coupling section and a signal path that connects the matching section and the coupling section, the first-frequency transmission element (i) giving passage to a signal having the first frequency and (ii) blocking a signal having the second frequency.

Therefore, the wireless device of the present invention is capable of reducing deterioration in properties of an antenna included in a joint part, which wireless device includes an antenna in one of two casings, and includes, in the joint part where the two casings are joined together, another antenna different from the antenna included in the casing.

BRIEF DESCRIPTION OF DRAWINGS

FIG. 2(*b*) is a cross-sectional view showing a configuration of a wireless device in accordance with an embodiment of the present invention.

FIG. 3(*b*) is a block diagram showing an example of how reactive elements included in a filter element are connected, in a case where the filter element constructs a transmission element included in a wireless device in accordance with an embodiment of the present invention.

FIG. 3(*c*) is a block diagram showing an example of how reactive elements included in a filter element are connected, in a case where the filter element constructs a transmission element included in a wireless device in accordance with an embodiment of the present invention.

FIG. 3(*d*) is a block diagram showing an example of how reactive elements included in a filter element are connected, in a case where the filter element constructs a transmission element included in a wireless device in accordance with an embodiment of the present invention.

FIG. 3(*e*) is a block diagram showing an example of how reactive elements included in a filter element are connected, in a case where the filter element constructs a transmission element included in a wireless device in accordance with an embodiment of the present invention.

FIG. 4 is a chart showing an example of how reactive elements constructing a filter element are arranged, in a case where the filter element constructs a transmission element included in a wireless device in accordance with an embodiment of the present invention.

FIG. 11(*b*) is a block diagram showing a configuration of a wireless device in accordance with a conventional example.

DESCRIPTION OF EMBODIMENTS

The following describes an embodiment of the present invention, with reference to drawings.

First Embodiment

The following describes First Embodiment of the present invention, with reference to FIGS. 1 to 6.

(Configuration of Wireless Device 1)

Figure 1:
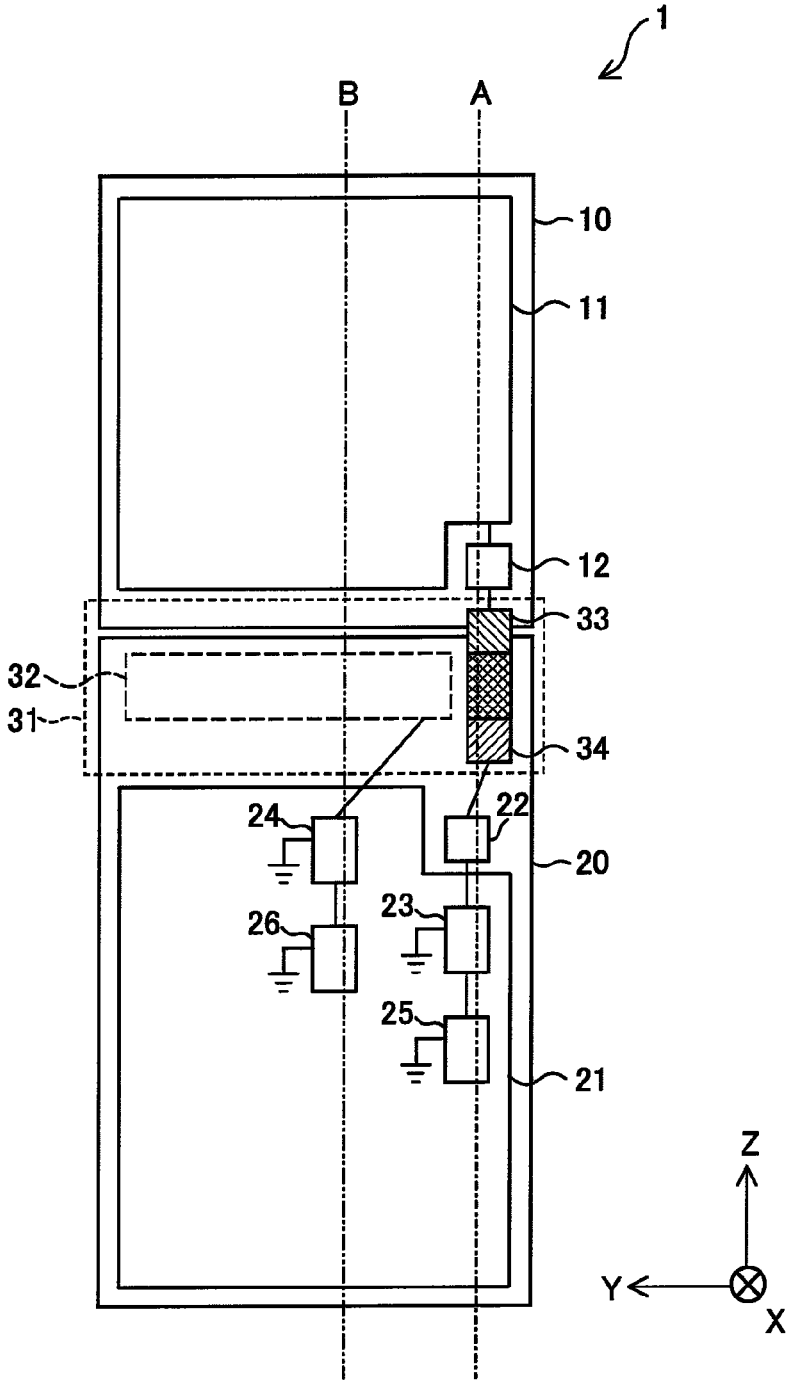
FIG. 1 is a block diagram showing a configuration of a wireless device in accordance with an embodiment of the present invention.

The following describes a configuration of a wireless device 1 in accordance with the present embodiment, with reference to FIG. 1. FIG. 1 is a block diagram showing a configuration of the wireless device 1, in which the wireless device of the present invention is employed into a foldable phone.

As shown in FIG. 1, the wireless device 1 has two casings: an upper casing 10 (first casing) and a lower casing 20 (second casing), which two casings are joined to each other at a hinge part 31 (joint part) that includes an end of the upper casing 10 and an end of the lower casing 20. The wireless device 1 has a folded structure in which the hinge part 31 hinges the upper casing 10 and the lower casing 20. This structure allows the upper casing 10 and the lower casing 20 to be rotatable about the hinge part 31.

The upper casing 10 includes a casing antenna 11 (first antenna) that is a conductive pattern, and a transmission element 12 (first-frequency transmission element) that gives passage to just high-frequency signals having a specific frequency. The hinge part 31 includes a built-in antenna 32 (second antenna) that resonates with a frequency (second-frequency: hereinafter referred to as second frequency) different from a frequency (first-frequency: hereinafter referred to as first frequency) with which the casing antenna 11 resonates. The lower casing 20 includes (i) a radio unit circuit 25 that processes a high-frequency signal having the first frequency with which the casing antenna 11 resonates, (ii) a radio unit circuit 26 (signal processing section) that processes a high-frequency signal having the second frequency with which the built-in antenna 32 resonates, (iii) a matching circuit 23 (matching section) for matching impedance with that of the casing antenna 11 in accordance with the radio unit circuit 25, (iv) a matching circuit 24 for matching impedance with that of the built-in antenna 32 in accordance with the radio unit circuit 26, (v) a lower casing ground pattern 21, and (vi) a transmission element 22 that gives passage to just high-frequency signals having a specific frequency. As shown in FIG. 1, the matching circuits 23 and 24 and the radio unit circuits 25 and 26 are connected to the lower casing ground pattern 21. The transmission elements 12 and 22 are described later in detail. The radio unit circuits 25 and 26 process the high-frequency signal having the first frequency and the high-frequency signal having the second frequency, respectively. The radio unit circuits 25 and 26 have the same configurations as a conventional radio unit circuit disclosed in Patent Literature 1; thus, detailed descriptions of the radio unit circuits 25 and 26 are omitted in the present embodiment.

In the wireless device 1 of the present embodiment, the casing antenna 11 is described as an antenna that resonates with an UHF (Ultra High Frequency: 470 to 770 MHz) band, and the built-in antenna 32 is described as a multiband antenna that can resonate with a GSM (Global System for Mobile Communications: 900 MHz) band, DCS (Digital Cellular Systems: 1.8 GHz) band, PCS (Personal Communication Services: 1.9 GHz) band, and WCDMA (Wideband Code Division Multiple Access: 2 GHz) band. However, the present invention is not limited to this. The casing antenna 11 may be a multiband antenna that can resonate with a plurality of frequency bands, or the built-in antenna 32 may be an antenna that resonates with a single frequency band. As another concrete example, the casing antenna 11 may resonate with at least one of frequency bands of the UHF band, AMPS (Advanced Mobile Phone Service: 850 MHz) band and GSM band, and the built-in antenna 32 may resonate with at least one of the frequency bands of DCS band, PCS band and WCDMA band. In the present embodiment, as a best mode of the embodiment, the frequency bands with which the casing antenna 11 and the built-in antenna 32 resonate are as the aforementioned. However, the frequency bands with which the casing antenna 11 and the built-in antenna 32 resonate can be changed as appropriate in accordance with a specification of the wireless device, and the casing antenna 11 and the built-in antenna 32 may resonate with frequency bands other than those described above.

(Configuration of Hinge Part 31)

Figure 2:
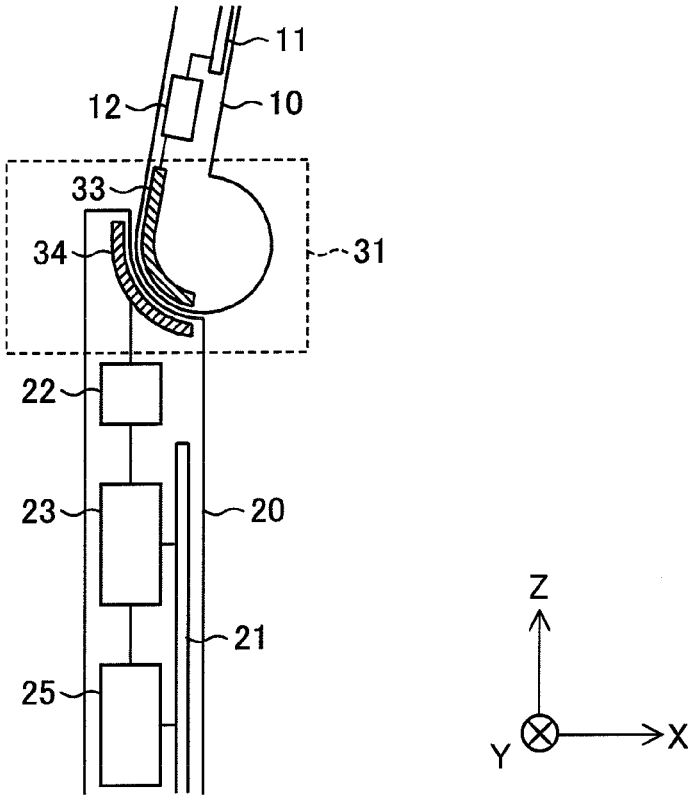
FIG. 2(*a*) is a cross-sectional view showing a configuration of a wireless device in accordance with an embodiment of the present invention.
Figure 2:
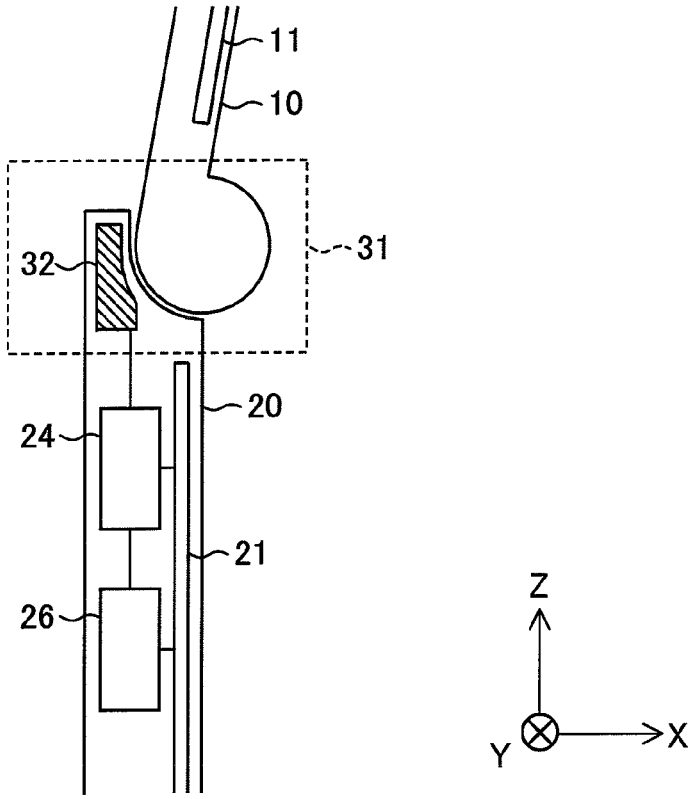

The following describes a detailed configuration of the hinge part 31, with reference to FIG. 2(*a*) and FIG. 2(*b*). FIG. 2(*a*) is a cross-sectional view of the wireless device 1, taken on line A shown in FIG. 1. FIG. 2(*b*) is a cross-sectional view of the wireless device 1, taken on line B shown in FIG. 1.

As shown in FIG. 2(*a*), the hinge part 31 includes ends of the upper casing 10 and the lower casing 20; in other words, the hinge part 31 is a part where the upper casing 10 and the lower casing 20 overlap each other. Further, the hinge part 31 of the upper casing 10 includes a feeding section 33 (first conductor section), and the hinge part 31 of the lower casing 20 includes a feeding section 34 (second conductor section). These feeding sections 33 and 34 are made of conductive material, and are disposed separately from each other. Therefore, the feeding sections 33 and 34 are disposed in a non-conductive manner in terms of continuous current, however are coupled to each other by electrostatic capacitance determined by areas and distances of the feeding sections 33 and 34 that face each other. In other words, the feeding sections 33 and 34 are electromagnetically coupled to each other, and give passage to the high-frequency signal having the first frequency with which the casing antenna 11 resonates.

As shown in FIG. 2(*a*), the transmission element 12 is disposed in such a manner that the transmission element 12 does not overlap the casing antenna 11 in an X direction shown in FIG. 2(*a*), which casing antenna 11 serves as a ground pattern of the upper casing. Further, the transmission element 22 is disposed in such a manner that the transmission element 22 does not overlap the lower casing ground pattern 21 in the direction X shown in FIG. 2(*a*). As a concrete example, it is preferable that the transmission element 12 is more than 1 mm away from the casing antenna 11 that serves as the ground pattern of the upper casing, and the transmission element 22 is more than 1 mm away from the lower casing ground pattern 21.

As shown in FIG. 2(*b*), the hinge part 31 of the lower casing 20 includes the built-in antenna 32. This built-in antenna 32 is connected to the matching circuit 24. Therefore, the high-frequency signal having the second frequency with which the built-in antenna 32 resonates is transmitted to the radio unit circuit 26 via the matching circuit 24, and is processed in the radio unit circuit 26.

It should be noted that, as shown in FIG. 2(*a*), the wireless device 1 of the present embodiment has the transmission element 12 provided on a signal path that connects the casing antenna 11 and the feeding section 33, and has the transmission element 22 provided on a signal path that connects the feeding section 34 and the matching circuit 23. The following describes the transmission elements 12 and 22.

The upper casing 10 of the present embodiment is constructed of a cabinet (not shown) that is made of resin material, and the cabinet made of the resin material includes the casing antenna 11, the transmission element 12 and the feeding section 33. However, the present invention encompasses a structure in which the feeding section 33 and the cabinet of the upper casing 10 are integrated as one structure.

Similarly, the lower casing 20 of the present embodiment is constructed of a cabinet (not shown) that is made of resin material, and the cabinet made of the resin material includes the built-in antenna 32, the feeding section 34, the transmission element 22, the matching circuits 23 and 24, and the radio unit circuits 25 and 26. However, the present invention encompasses a structure in which the feeding section 34 and the cabinet of the lower casing 20 are integrated as one structure.

Further, in the present embodiment, the cabinet of the upper casing 10 is made of the resin material, and the casing antenna 10 is provided separately from the cabinet. However, the present invention also encompasses a structure in which the cabinet of the upper casing 10 is made of conductive material such as a metal case, and this cabinet made of the conductive material is used as the casing antenna 11.

(Configurations of Transmission Elements 12 and 22)

The following describes the transmission elements 12 and 22 included in the wireless device 1 of the present embodiment. The transmission elements 12 and 22 included in the wireless device 1 have properties of (i) giving passage to the high-frequency signal having the first frequency with which the casing antenna 11 resonates and (ii) blocking the high-frequency signal having the second frequency with which the built-in antenna 32 resonates. The transmission elements 12 and 22 having these properties are constructed of filter elements in which reactive elements of a coil, a capacitor and the like are used in combination.

Figure 3:
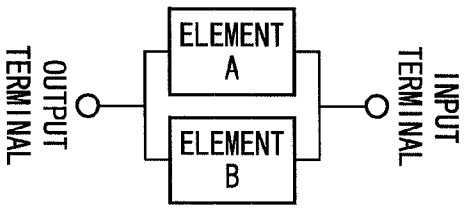
FIG. 3(*a*) is a block diagram showing an example of how reactive elements included in a filter element are connected, in a case where the filter element constructs a transmission element included in a wireless device in accordance with an embodiment of the present invention.
Figure 3:
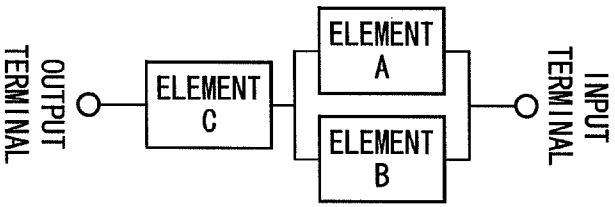
Figure 3:
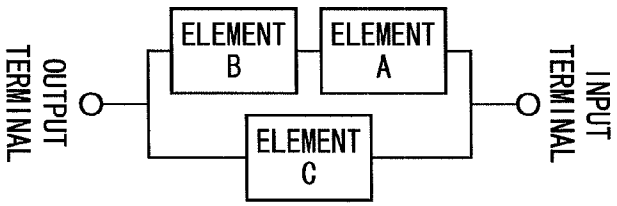
Figure 3:
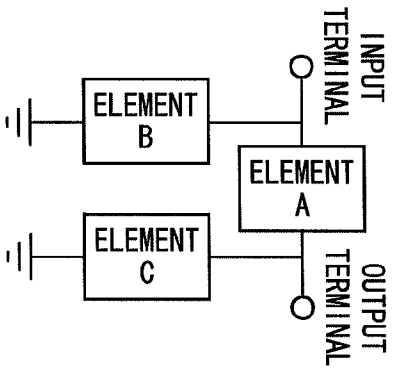
Figure 3:
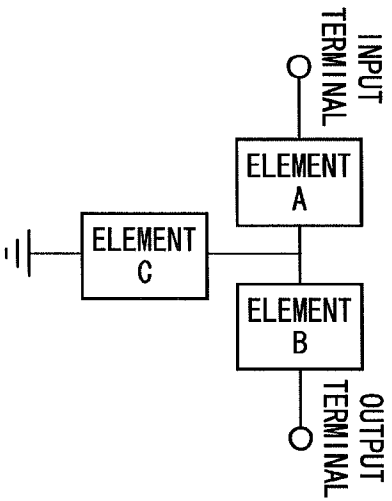

The following describes examples of configurations of the transmission elements 12 and 22 having the foregoing properties, with reference to FIG. 3(*a*) to FIG. 3(*e*) and FIG. 4. FIG. 3(*a*) to FIG. 3(*e*) are block diagrams of examples showing connection examples "a" to "e" of reactive elements in a filter element, in cases where the transmission elements 12 and 22 are constructed of the filter element in which the reactive elements of a capacitor, a coil and the like are used in combination. FIG. 4 is a chart showing an example of how the reactive elements are arranged in the connection examples "a" to "e" shown in FIG. 3(*a*) to FIG. 3(*e*).

Element A, element B, and element C shown in FIG. 3(*a*) to FIG. 3(*e*) each have a coil or a capacitor disposed thereto, in accordance with the respective connection examples. As to places to which an input terminal and output terminal shown in FIG. 3(*a*) to FIG. 3(*e*) are connected, in a case where the connection example is applied to the transmission element 12, the feeding section 33 is connected to the input terminal, and the casing antenna 11 is connected to the output terminal. Meanwhile, in a case where the connection example is applied to the transmission element 22, the feeding section 34 is connected to the input terminal, and the matching circuit 23 is connected to the output terminal. Further, the input and output terminals shown in FIG. 3(*a*) to FIG. 3(*e*) may be connected vice versa. Concretely, in the case where the connection example is applied to the transmission element 12, the casing antenna 11 may be connected to the input terminal, and the feeding section 33 may be connected to the output terminal. Meanwhile, in the case where the connection example is applied to the transmission element 22, the matching circuit 23 may be connected to the input terminal, and the feeding section 34 may be connected to the output terminal.

As shown in FIG. 3(*a*), the filter element may be constructed so that the elements A and B are connected in parallel between the input terminal and the output terminal. In the connection example "a", as shown in FIG. 4, a coil is disposed to the element A, and a capacitor is disposed to the element B.

As shown in FIG. 3(*b*), the filter element may be constructed so that the element A and the element B are connected in parallel between the input terminal and the output terminal, and the element A and the element B are connected to each other on their output terminal sides to connect the element C in series between the connection of the elements A and B and the output terminal. In the connection example "b", as shown in FIG. 4, a coil is disposed to the element A, a capacitor is disposed to the element B, and a coil or a capacitor is disposed to the element C.

As shown in FIG. 3(*c*), the filter element may be constructed so that the element A and the element B are connected in series between the input terminal and the output terminal, and the element C is connected in parallel with the elements A and B. In the connection example "c", as shown in FIG. 4, a coil is disposed to the element A, a capacitor is disposed to the element B, and a coil or a capacitor is disposed to the element C.

As shown in FIG. 3(*d*), the filter element may be constructed so that the element A is connected between the input terminal and the output terminal, the element B is connected between (i) a connection point of the element A and the input terminal and (ii) a ground pattern, and the element C is connected between (i) a connection point of the element A and the output terminal and (ii) a ground pattern. The connection example "d", as shown in FIG. 4, has two arrangement examples: one arrangement example is a case where a coil is disposed to the element A, and a capacitor is disposed to each of the elements B and C; and the other arrangement example is a case where a capacitor is disposed to the element A, and a coil is disposed to each of the elements B and C.

As shown in FIG. 3(*e*), the filter element may be constructed so that the element A and the element B are connected in series between the input terminal and the output terminal, and the element C is connected between (i) a connection point of the element A and the element B and (ii) a ground pattern. The connection example "e", as shown in FIG. 4, has two arrangement examples: one arrangement example is a case where a coil is disposed to each of the elements A and B, and a capacitor is disposed to the element C; and the other arrangement example is a case where a capacitor is disposed to each of the elements A and B, and a coil is disposed to the element C.

The reactive elements constructing the transmission elements 12 and 22 have inductance values and capacitance values set as appropriate in accordance with connection examples in FIG. 3 and arrangement examples in FIG. 4, so that the transmission elements 12 and 22 have properties of (i) giving passage to the high-frequency signal having the first frequency and (ii) blocking the high-frequency signal having the second frequency. Further, connection and arrangement of the reactive elements constructing the transmission elements 12 and 22 are not limited to the connection examples shown in FIG. 3(*a*) to FIG. 3(*e*) and arrangement examples shown in FIG. 4; as long as the transmission elements 12 and 22 have the foregoing properties, other connections and arrangements may be employed. Furthermore, it is not necessary to have the transmission element 12 be connected and disposed in the same manner as the transmission element 22. The transmission elements 12 and 22 may be connected and disposed differently from each other. The transmission elements 12 and 22 may also be made by using, in combination, a plurality of filters that have the structures shown in FIG. 3(*a*) to FIG. 3(*e*). Concretely, the transmission elements 12 and 22 may be made by using two of the filters shown in FIG. 3(*a*) in combination. The transmission elements 12 and 22 may also be made by using, in combination, the filter shown in FIG. 3(*a*) and that shown in FIG. 3(*d*), respectively. In the present embodiment, the reactive elements of the coil, the capacitor and the like are used in order to construct the transmission elements 12 and 22 by use of the filter elements. However, the present invention is not limited to this. The transmission elements 12 and 22 may be constructed by use of dielectric filters.

Another example of the configuration of the transmission elements 12 and 22 constructed of the filter elements is a configuration in which the transmission elements 12 and 22 are formed by a signal line pattern formed on a FPC (Flexible Printed Circuits), a wiring substrate or the like. The configuration makes it possible to construct the feeding section 33 and the feeding section 34 of the FPC, and to make one FPC serve as the feeding section and the transmission element. Concretely, the configuration allows constructing the feeding section 33 by use of the FPC, forming the transmission element 12 by use of the signal line pattern of the FPC, and integrating the function as the feeding section 33 and the function as the transmission element 12 into a single FPC.

As described above, by including the transmission elements 12 and 22, the wireless device 1 of the present embodiment has the feeding section 33 disconnected from the casing antenna 11 that is the ground pattern, and has the feeding section 34 disconnected from the lower casing ground pattern 21, in the second frequency with which the built-in antenna 32 resonates. As a result, the feeding sections 33 and 34 disposed close to the built-in antenna 32 are disconnected from the ground patterns; in other words, the feeding sections 33 and 34 disposed close to the built-in antenna 32 less serve as a ground, thereby increasing electrical volume of the built-in antenna 32. As a result, the wireless device 1 is capable of reducing deterioration in properties of the built-in antenna 32, which deterioration is caused by the ground patterns being disposed close to the built-in antenna 32.

In the present embodiment, the feeding section 33 is non-conductively but electromagnetically coupled to the feeding section 34. However, the present invention is not limited to this. The present invention may include such a configuration that the feeding section 33 is in contact with and is electrically connected to the feeding section 34. Even with this case, the wireless device 1 yields the same effect as that described above.

Further, in the present embodiment, the wireless device 1 has a folded structure in which the hinge part 31 hinges the upper casing 10 and the lower casing 20. However, the present invention is not limited to this. The present invention may include a slide type structure in which the upper casing 10 slides on the lower casing 20.

The wireless device 1 of the present embodiment includes both the transmission elements 12 and 22. However, the present invention is not limited to this, and the wireless device 1 of the present invention may include just one of the transmission elements 12 and 22. The following describes a wireless device including just the transmission element 12 as Modification 1 of the foregoing wireless device 1, and describes a wireless device including just the transmission element 22 as Modification 2 of the foregoing wireless device 1.

(Modification 1)

Figure 5:
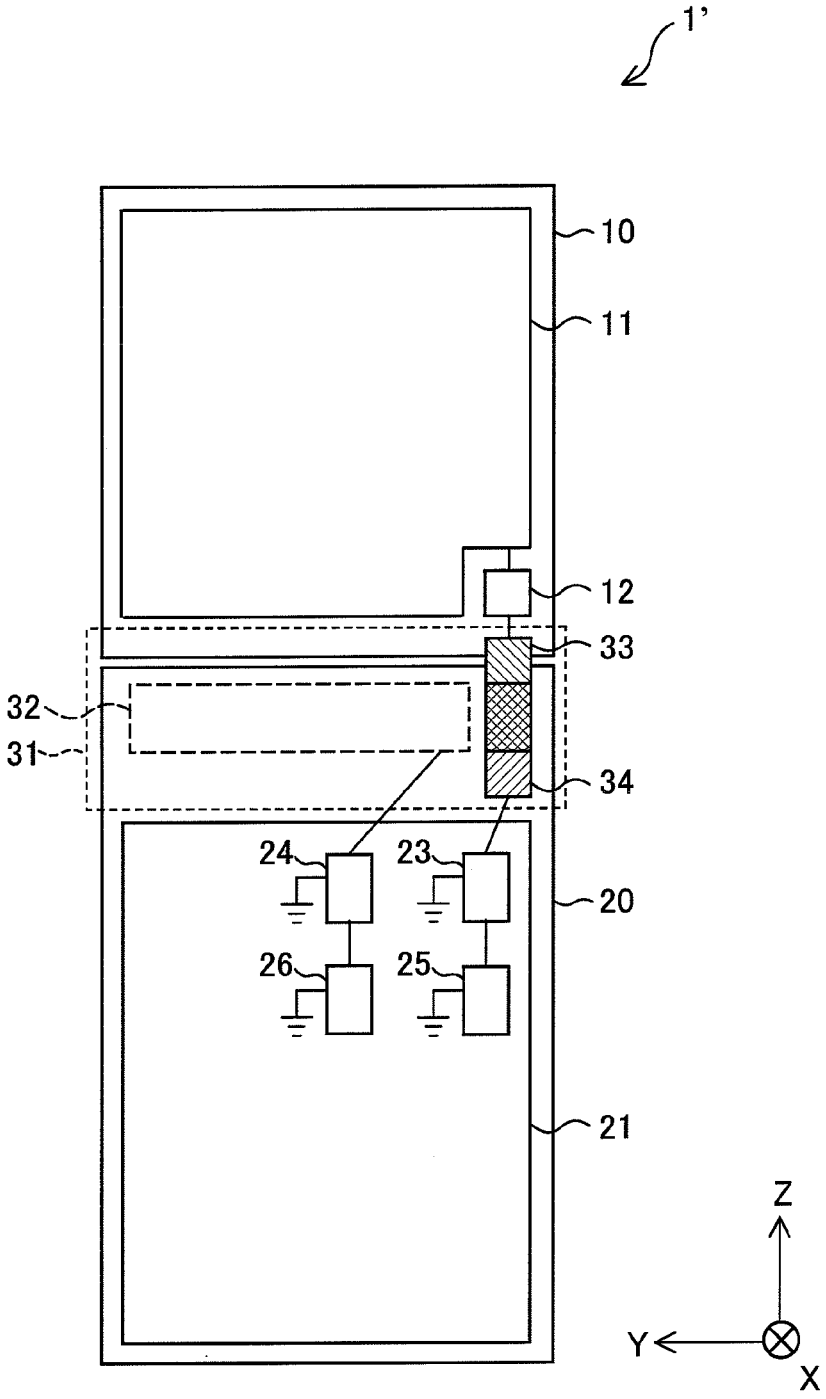
FIG. 5 is a block diagram showing a modification of the wireless device shown in FIG. 1, in accordance with an embodiment of the present invention.

The following describes a wireless device 1' that is a modification of the wireless device 1, with reference to FIG. 5. FIG. 5 is a block diagram showing a configuration of the wireless device 1'. As described above, the wireless device 1' is a modification of the wireless device 1 shown in FIG. 1. Therefore, the following description provides explanations of the wireless device 1' for points different from those of the foregoing wireless device 1; identical reference signs are provided to members that have identical features and functions with the members of the foregoing wireless device 1, and descriptions of such identical members are omitted here.

As shown in FIG. 5, the wireless device 1' includes no transmission element 22, but includes just the transmission element 12. The transmission element 12 included in the wireless device 1' disconnects the feeding section 33 from the casing antenna 11 that serves as the ground pattern of the upper casing 10, in the second frequency with which the built-in antenna 32 resonates. As a result, the wireless device 1' has the feeding sections 33 and 34 less serve as a ground than in a case where the wireless device 1' includes no transmission element 12. This increases the electrical volume of the built-in antenna 32, thereby reducing the deterioration in the properties of the built-in antenna 32.

(Modification 2)

Figure 6:
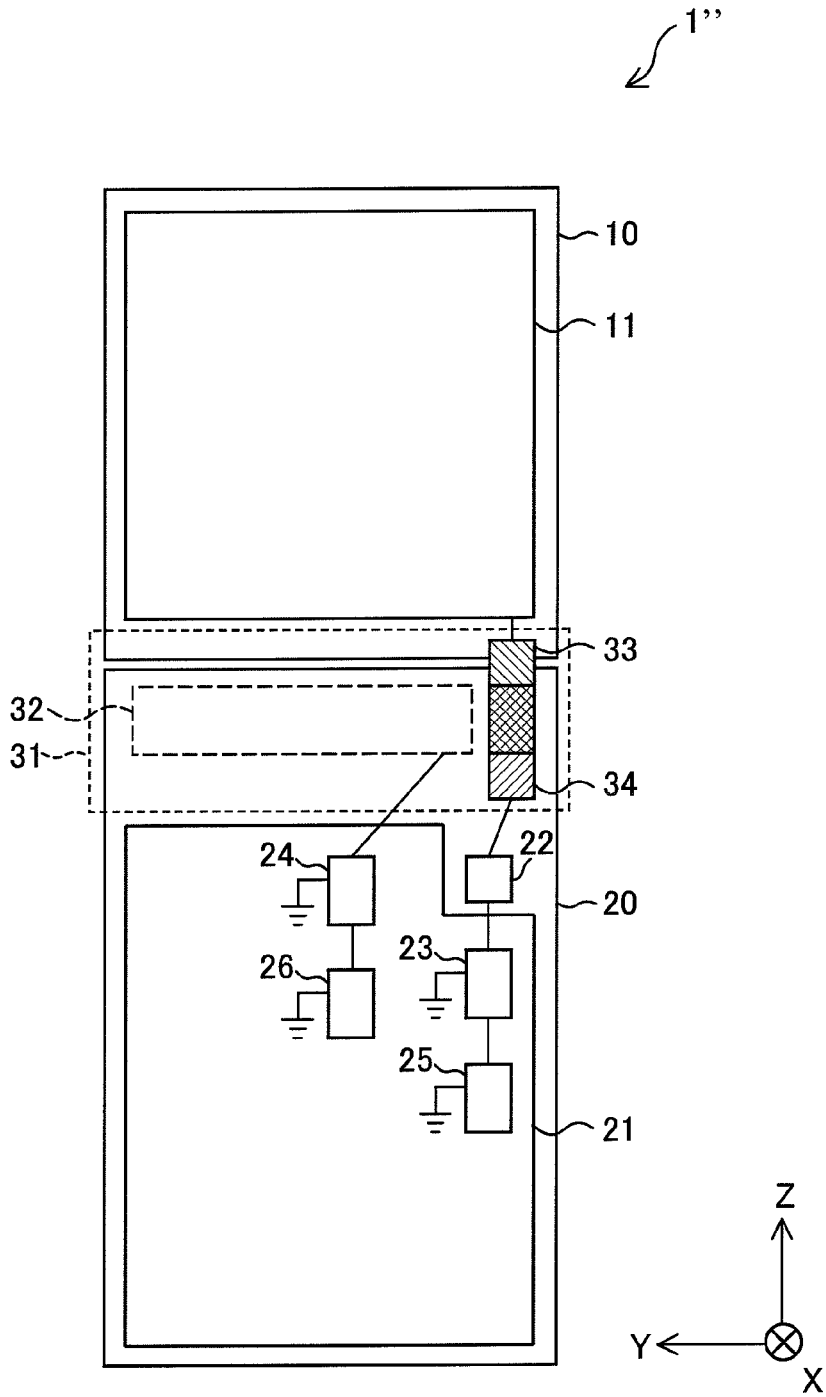
FIG. 6 is a block diagram showing another modification of the wireless device shown in FIG. 1, in accordance with an embodiment of the present invention.

The following describes a wireless device 1" that is a modification of the wireless device 1, with reference to FIG. 6. FIG. 6 is a block diagram showing a configuration of the wireless device 1". As described above, the wireless device 1" is a modification of the wireless device 1 shown in FIG. 1. Therefore, the following description provides explanations of the wireless device 1" for points different from those of the foregoing wireless device 1; identical reference signs are provided to members that have identical features and functions with the members of the foregoing wireless device 1, and descriptions of such identical members are omitted here.

As shown in FIG. 6, the wireless device 1" includes no transmission element 12, but includes just the transmission element 22. The transmission element 22 included in the wireless device 1" disconnects the feeding section 34 from the lower casing ground pattern 21, in the second frequency with which the built-in antenna 32 resonates. As a result, the wireless device 1" has the feeding sections 33 and 34 less serve as a ground than in a case where the wireless device 1" includes no transmission element 22. This increases the electrical volume of the built-in antenna 32, thereby reducing the deterioration in the properties of the built-in antenna 32 as a result.

In the present embodiment, the built-in antenna 32 is included in the hinge part 31 of the lower casing 20. However, the present invention is not limited to this, and the built-in antenna 32 may be included in the hinge part 31 of the upper casing 10.

Second Embodiment

In First Embodiment described above, the transmission elements 12 and 22 are constructed of the filter elements. The present invention may have the transmission elements 12 and 22 be constructed of RF switches instead of the filter elements, which RF switches are switching elements.

Figure 7:
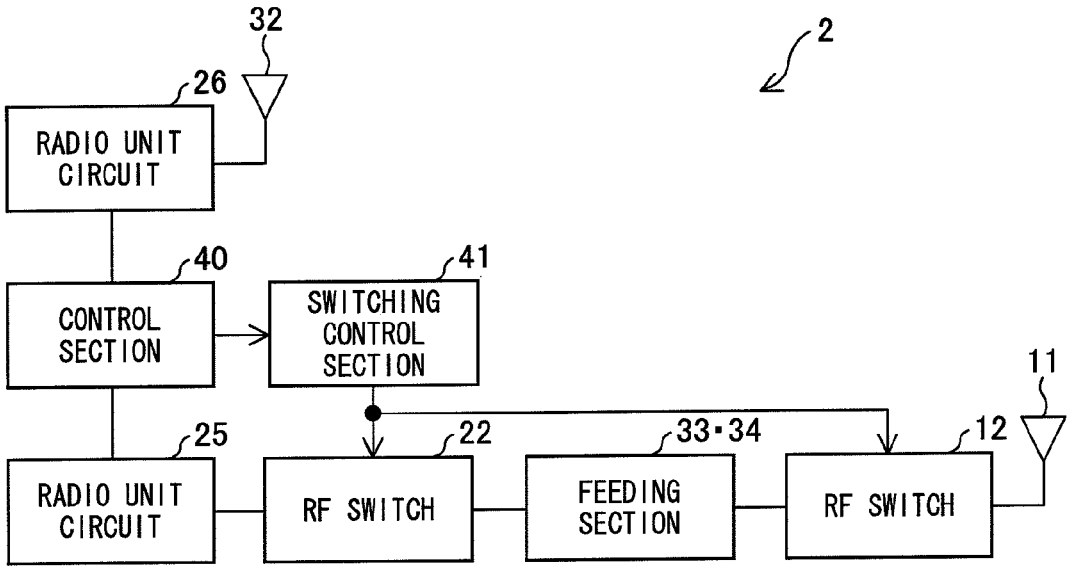
FIG. 7 is a block diagram showing a configuration of a wireless device, in a case where an RF switch constructs a transmission element included in a wireless device, in accordance with another embodiment of the present invention.
Figure 8:
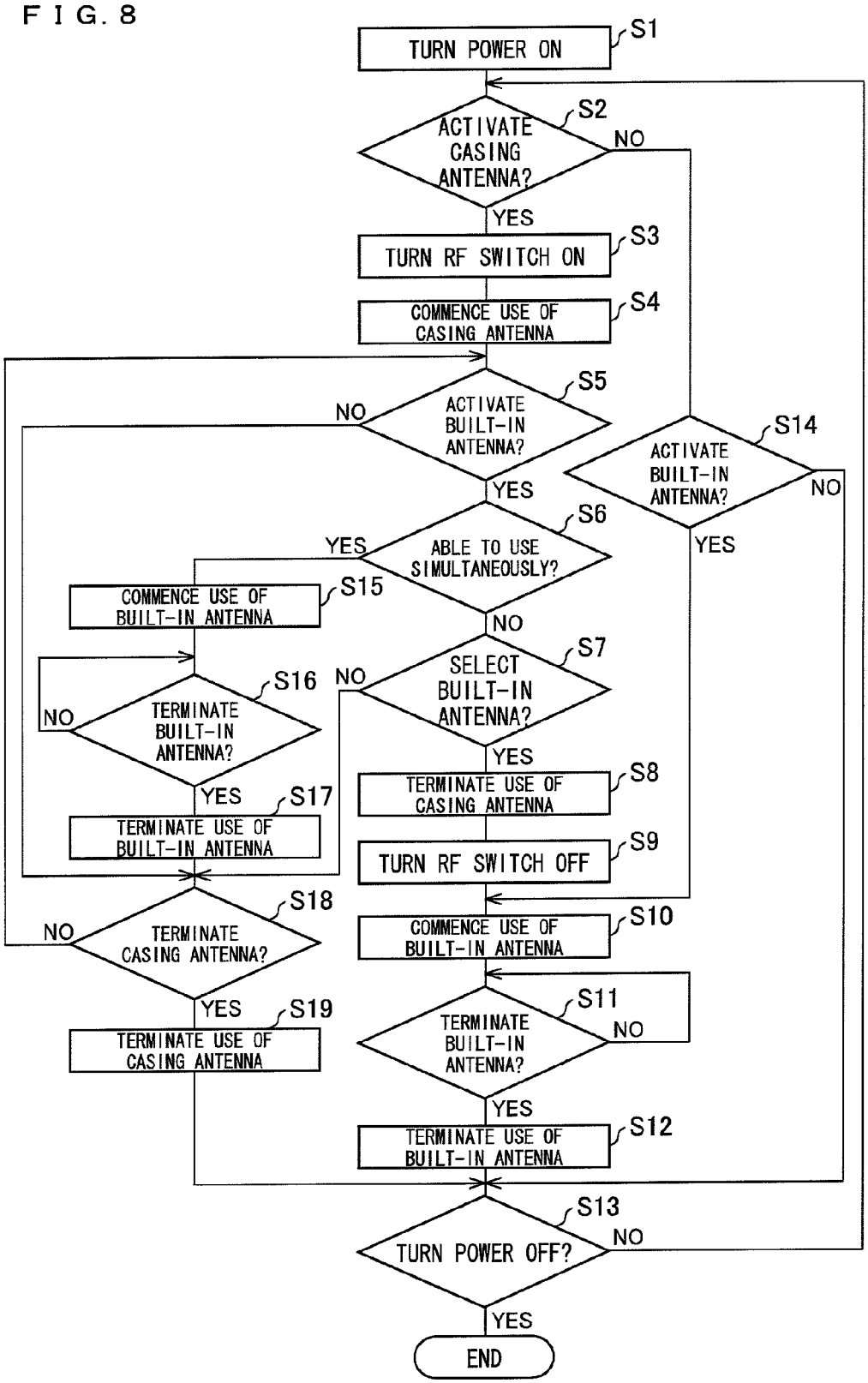
FIG. 8 is a flowchart diagram showing a switching operation of an RF switch, in a case where the RF switch constructs a transmission element included in a wireless device, in accordance with another embodiment of the present invention.

The following describes a wireless device 2 as Second Embodiment of the present invention, with reference to FIGS. 7 and 8, in which the transmission elements 12 and 22 are constructed of the RF switches. FIG. 7 is a block diagram showing a configuration for controlling the RF switches included in the wireless device 2, in the case where the transmission elements 12 and 22 are constructed of the RF switches. The wireless device 2 has a basic structure identical to that of the wireless device 1 described in First Embodiment. Therefore, descriptions are provided for points that are different from those of the wireless device 1 of First Embodiment; identical reference signs are provided to members having identical features and functions with the members of the foregoing wireless device 1, and descriptions of such identical members are omitted in the embodiment. Further, FIG. 7 shows members just related to controlling the RF switches, and other members shown in FIG. 1 are omitted in illustration.

(Configuration of Wireless Device 2)

As shown in FIG. 7, the wireless device 2 in which the transmission elements 12 and 22 are constructed of the RF switches further includes, in addition to the configuration of the wireless device 1 shown in FIG. 1, a switching control section 41 for controlling the transmission elements 12 and 22 constructed of the RF switches, and a control section 40 that outputs an instruction signal to the switching control section 41. In FIG. 7, an RF switch 12 is the transmission element 12, and an RF switch 22 is the transmission element 22.

(Switching Operations of RF switches 12 and 22)

The following describes switching operations of the RF switches 12 and 22 in the wireless device 2, with reference to FIG. 8. FIG. 8 is a flowchart showing a switching operation process of the RF switches 12 and 22 in the wireless device 2.

First, power of the wireless device 2 is turned ON by a user of the wireless device 2 (step 1: hereinafter referred to as S1). Thereafter, the control section 40 detects, by use of a user interface (not shown) or the radio unit circuit 25, whether or not the casing antenna 11 is activated (S2). The casing antenna 11 is activated in a case where the user interface detects an instruction, from the user, to commence television reception of an UHF band that is of the first frequency.

The control section 40, upon detection of activation of the casing antenna 11 in S2, outputs, to the switching control section 41, an instruction signal for instructing the switching control section 41 to turn the RF switches 12 and 22 ON. In accordance with the instruction signal outputted to the switching control section 41, the switching control section 41 turns the RF switches 12 and 22 ON (S3). By turning the RF switches 12 and 22 ON, the casing antenna 11 and the radio unit circuit 25 become electrically connected to each other. On the other hand, by turning the RF switches 12 and 22 OFF, the casing antenna 11 and the radio unit circuit 25 become electrically disconnected from each other. This definition also applies in the following descriptions. Meanwhile, in S2, if the control section 40 detects that the casing antenna 11 is not activated, the control section 40 proceeds to a process of S14.

Next, in S3, when the control section 40 turns the RF switches 12 and 22 ON by the switching control section 41, then the wireless device 2 starts using a communication system of a first frequency, by use of the casing antenna 11 (S4).

Next, in S4, once the wireless device 2 starts using the communication system of the first frequency, the control section 40 detects whether or not the built-in antenna 32 is activated, by use of the user interface (not shown) or the radio unit circuit 26 (S5). The built-in antenna 32 is activated when the user interface detects an instruction, from the user, to commence use of a communication system of a second frequency, or when the built-in antenna 32 and the radio unit circuit 26 receive a call signal from a base station in a case where the communication system of the second frequency is a two-way communication system such as voice communication.

Once the control section 40 detects, in S5, that the built-in antenna 32 is activated, then the control section 40 compares the first frequency with which the casing antenna 11 resonates, with the second frequency with which the built-in antenna 32 resonates, and determines whether or not the communication system of the first frequency and the communication system of the second frequency are usable simultaneously (S6). On the other hand, when the control section 40 detects that the built-in antenna 32 is not activated, the control section 40 proceeds to a process of S18.

In a case where the control section 40 determines, in S6, that the communication system of the first frequency and the communication system of the second frequency are usable simultaneously, the control section 40 proceeds to a process of S15. However, in a case where the control section 40 determines that the foregoing two communication systems cannot be used simultaneously, the control section 40 informs the user that the foregoing two communication systems cannot be used simultaneously, and detects which of the two communication systems: the communication system for using the casing antenna 11 or the communication system for using the built-in antenna 32, is selected by the user (S7). In the present embodiment, either one of the two communication systems is selected by the user in S7. However, the present invention is not limited to this. The control section 40 may set priorities, in advance, to the frequency with which the casing antenna 11 resonates and the plurality of frequencies with which the built-in antenna 32 resonates, and the control section 40 may automatically select the communication system to be used, that is, the antenna to be used, in accordance with the priorities set in advance.

In S7, once the control section 40 detects that the communication system for using the built-in antenna 32 is selected, the control section 40 then outputs, to the radio unit circuit 25, an instruction for terminating use of the casing antenna 11 (S8). Meanwhile, when the control section 40 detects that the communication system for using the casing antenna 11 is selected, the control section 40 proceeds to the process of S18.

After performing the process of S8, the control section 40 outputs, to the switching control section 41, an instruction signal for instructing the switching control section 41 to turn the RF switches 12 and 22 OFF. In accordance with the instruction signal, the switching control section 41 turns the RF switches 12 and 22 OFF (S9). After the RF switches 12 and 22 are turned OFF, the wireless device 2 starts using the communication system of the second frequency by use of the built-in antenna 32 (S10).

The wireless device 2 that has started using the communication system of the second frequency continuously uses the communication system of the second frequency until the control section 40 detects, by the user interface (not shown) or the radio unit circuit 26, that use of the built-in antenna 32 is terminated (S11). The use of the built-in antenna 32 is terminated when the user interface detects an instruction, from the user, to terminate the use of the communication system of the second frequency, or when the built-in antenna 32 and the radio unit circuit 26 receive a disconnection signal, from the base station, for disconnecting a communication link in a case where the communication system of the second frequency is the two-way communication system such as the voice communication.

Once the control section 40 detects, in S11, that the use of the built-in antenna 32 is terminated, the wireless device 2 terminates use of the communication system of the second frequency (S12). After performing the process of S12, the control section 40 detects whether or not the user interface (not shown) receives an instruction, from the user, to turn the wireless device 2 OFF. When the control section 40 detects that the user interface receives the instruction to turn the wireless device 2 OFF, the wireless device 2 is powered down by itself, and terminates its own operation process. Meanwhile, if the control section 40 does not detect, by the user interface, the instruction to turn the wireless device 2 OFF, the control section 40 proceeds to the process of S2.

Further, in a case where the control section 40 detects, in S3, that the casing antenna 11 is not activated, the control section 40 then detects, by the user interface (not shown) or the radio unit circuit 26, whether or not the built-in antenna 32 is activated (S14). In a case where the control section 40 detects that the built-in antenna 32 is not activated, the control section 40 proceeds to the process of S13. In a case where the control section 40 detects that the built-in antenna 32 is activated, the control section 40 proceeds to the process of S10.

Once the control section 40 detects, in S5, that the built-in antenna 32 is not activated, the control section 40 then detects whether or not the user interface (not shown) or the radio unit circuit 25 receives an instruction or signal for terminating the use of the casing antenna 11 (S18). Use of the casing antenna 11 is terminated in the case where the user interface detects an instruction, from the user, for terminating the television reception of the UHF band that is of the first frequency.

When the control section 40 detects, in S18, that the use of the casing antenna 11 is terminated, the wireless device 2 terminates use of the communication system of the first frequency (S19). After the process of S19 is performed, the control section 40 proceeds to the process of S13. On the other hand, if the control section 40 detects, in S18, that the use of the casing antenna 11 is not terminated, then the control section 40 proceeds to the process of S5.

In the case where the control section 40 determines, in S6, that the communication system of the first frequency and the communication system of the second frequency are usable simultaneously, the wireless device 2 starts using the communication system of the second frequency by using the built-in antenna 32 (S15).

The wireless device 2 that has started using the communication system of the second frequency continuously uses the communication system of the second frequency until the control section 40 detects, by the user interface (not shown) or the radio unit circuit 26, that the use of the built-in antenna 32 is terminated (S16). Once the control section 40 detects, in S16, that the use of the built-in antenna 32 is terminated, then the wireless device 2 terminates the use of the communication system of the second frequency (S17), and the control section 40 proceeds to the process of S18.

As described above, in the wireless device 2 of the present embodiment, the control section 40 obtains, by the user interface (not shown) or the radio unit circuit 25, information (first-antenna use information) indicating whether or not a system of the casing antenna 11 is activated, in other words, information indicating whether or not the casing antenna 11 is used. Further, the control section 40 also obtains, by the user interface (not shown) or the radio unit circuit 26, information (second-antenna use information) indicating whether or not a system of the built-in antenna 32 is activated, in other words, information indicating whether or not the built-in antenna 32 is used. In accordance with the two obtained information, the switching control section 41 switches between the RF switches 12 and 22. Therefore, when the wireless device 2 uses the communication system of the second frequency by use of the built-in antenna 32 in the case where the casing antenna 11 is not activated, the feeding sections 33 and 34 disposed close to the built-in antenna 32 are disconnected from the ground patterns. This reduces deterioration in properties of the built-in antenna 32, which deterioration is caused by the feeding sections 33 and 34 being disposed close to the ground patterns.

The wireless device 2 of the present embodiment includes both the RF switches 12 and 22. However, the wireless device 2 of the present embodiment may just include any one of the RF switches 12 and 22, as with Modifications 1 and 2 of First Embodiment. In the case where the wireless device 2 of the present embodiment includes any one of the RF switches 12 and 22, the wireless device 2 of the present embodiment yields the same effect as in a case where the wireless device 1 includes any one of the transmission elements 12 and 22 described in Modifications 1 and 2 of First Embodiment.

In First and Second Embodiments described above, the transmission elements 12 and 22 are constructed of the filter elements or the RF switches. However, the transmission elements 12 and 22 may be constructed of a combination of the filter element described in First Embodiment and the RF switch described in Second Embodiment, respectively.

Third Embodiment

Figure 9:
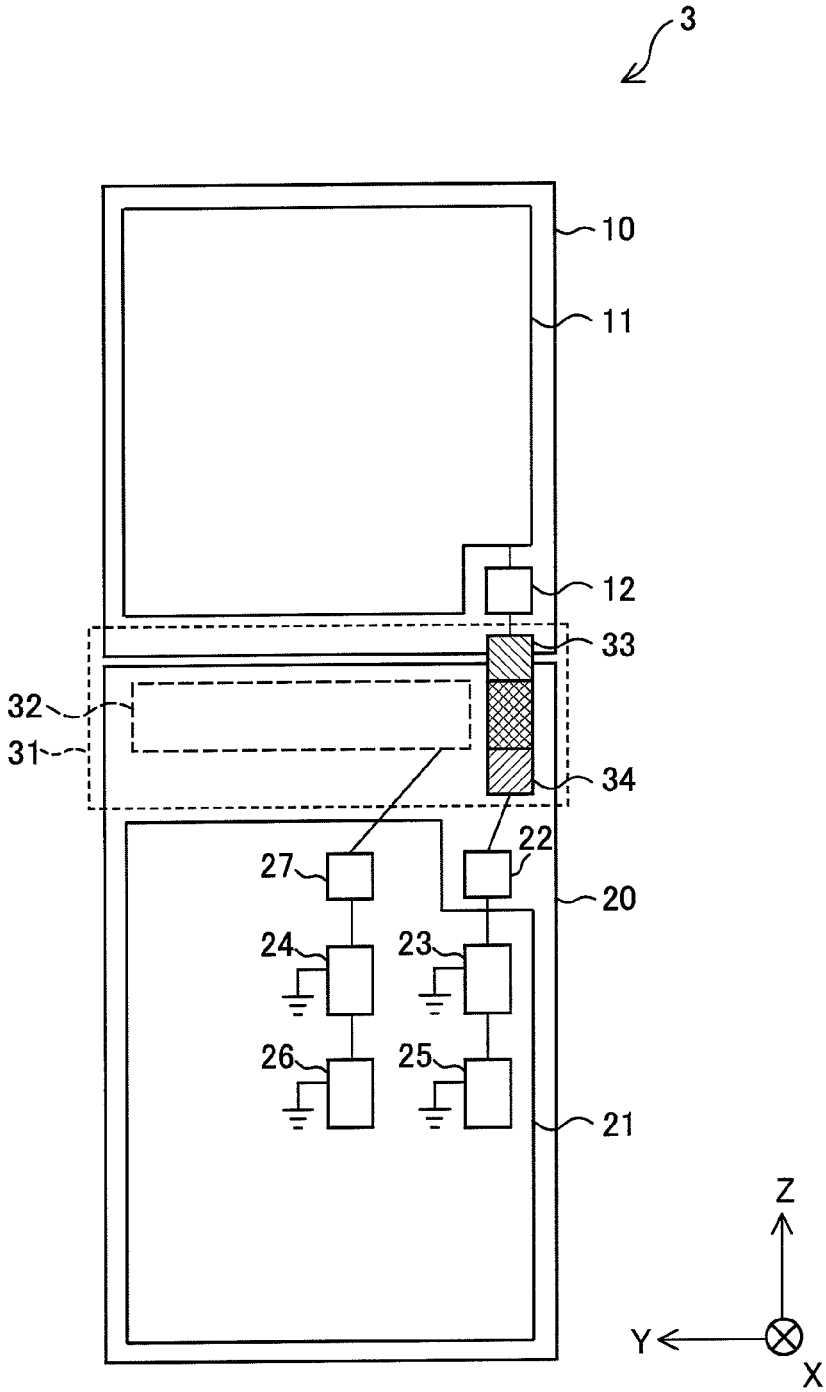
FIG. 9 is a block diagram showing a configuration of a wireless device in accordance with yet another embodiment of the present invention.

The following describes Third Embodiment of the present invention, with reference to FIG. 9. FIG. 9 is a block diagram showing a configuration of a wireless device 3 of the present embodiment. The wireless device 3 of Third Embodiment described below is a modification of the wireless device 1 of First Embodiment. Therefore, in the following description of Third Embodiment, explanations are provided for points different from those of First Embodiment described above; identical reference signs are provided to members that have identical features and functions with the members of First Embodiment, and descriptions of such identical members are omitted in the embodiment.

As shown in FIG. 9, the wireless device 3 of the present embodiment differs from the wireless device 1 of First Embodiment in that the wireless device 3 includes a transmission element 27 between the built-in antenna 32 and the matching circuit 24. The transmission element 27 has properties different from those of the transmission elements 12 and 22. The transmission element 27 (i) gives passage to the second frequency with which the built-in antenna 32 resonates and (ii) blocks the first frequency with which the casing antenna 11 resonates.

Before an effect attained by providing the transmission element 27 is described, a problem that can occur in a wireless device including two antennas that are disposed in respective upper casing and hinge part, is described. Concretely, in a wireless device including two antennas, when (i) one of the two antennas is included in the upper casing, (ii) a matching circuit of this antenna is included in a lower casing, and (iii) the other of the two antennas is included in the hinge part that includes ends of the upper and the lower casings, the antenna included in the hinge part (hereinafter referred to as a built-in antenna) and a feeding section of the antenna included in the upper casing (hereinafter referred to as a casing antenna) are disposed close to each other in the hinge part. As already described, the built-in antenna being disposed close to the feeding section of the casing antenna causes deterioration in properties of the built-in antenna. Not only this, the built-in antenna being disposed close to the feeding section of the casing antenna can also cause a problem that antenna properties of the casing antenna deteriorate. More specifically, when a high-frequency signal having a frequency with which the casing antenna resonates passes through the feeding section of the casing antenna, a part of electrical capacitance of the high-frequency signal is transmitted from the feeding section of the casing antenna to the built-in antenna. This causes reduction in a gain of the casing antenna.

To solve the problem, in the wireless device 3 of the present embodiment, the transmission element 27 having the above-mentioned properties is provided between the built-in antenna 32 and the matching circuit 24. This makes electrical length of the built-in antenna 32 short, in accordance with the first frequency with which the casing antenna 11 resonates. As a result, electrical capacitance of a high-frequency signal having the first frequency is reduced, which electrical capacitance is transmitted to the built-in antenna 32 from the feeding sections 33 and 34. This improves a gain of the casing antenna 11.

Figure 10:
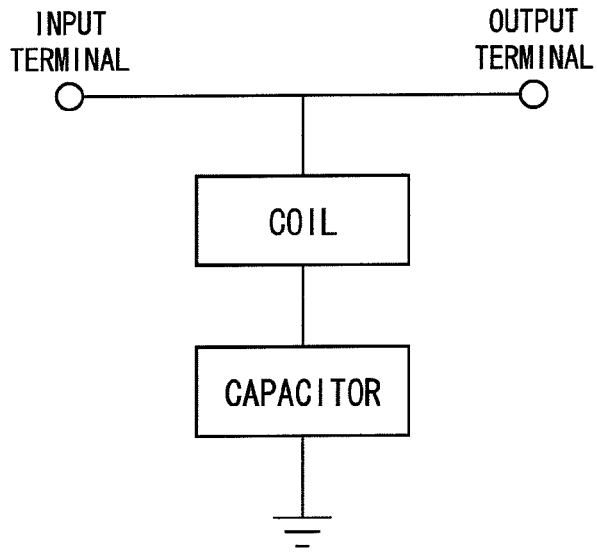
FIG. 10 is a block diagram showing a configuration of reactive elements included in a filter element, in a case where the filter element constructs a transmission element included in a wireless device in accordance with another embodiment of the present invention.
Figure 11:
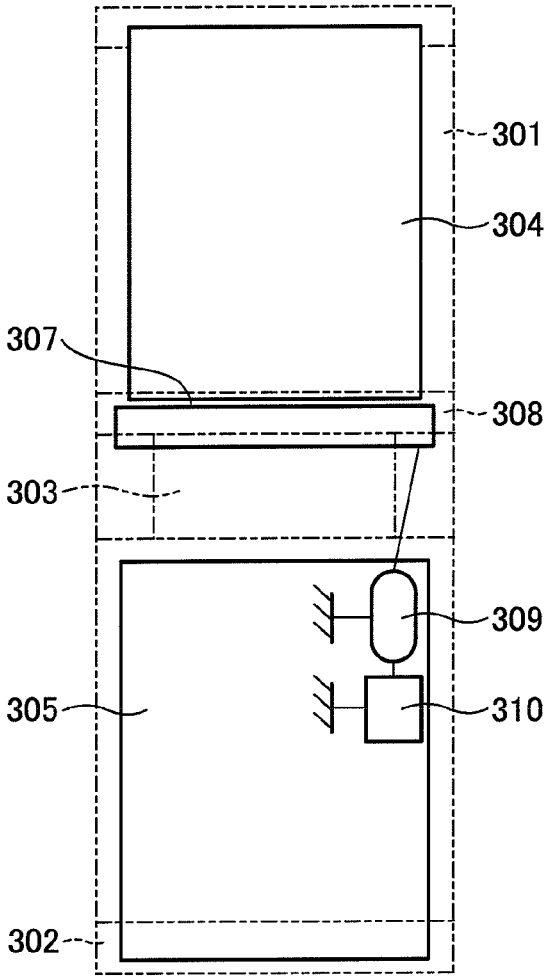
FIG. 11(*a*) is a block diagram showing a configuration of a wireless device in accordance with a conventional example.
Figure 11:
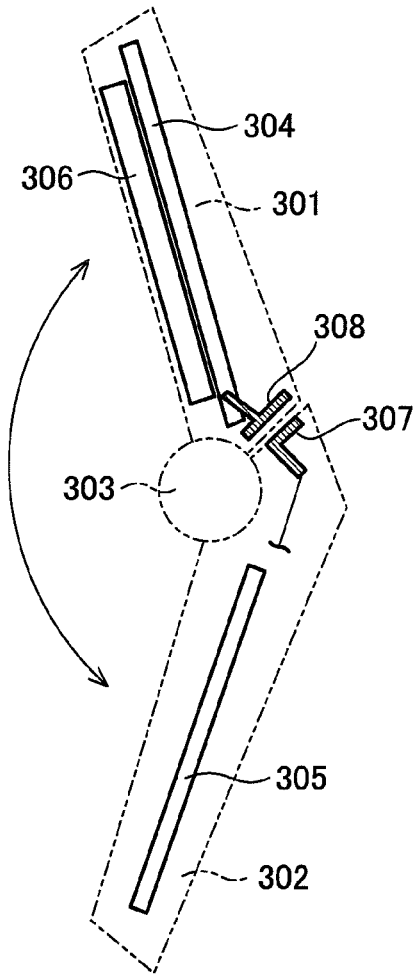

The transmission element 27 included in the wireless device 3 may be constructed of the filter element shown in FIGS. 3 and 4 of First Embodiment. In the case where the transmission element 27 is constructed of the filter element, the transmission element 27 may be constructed by use of a connection example of reactive elements shown in FIG. 10, which is a connection example not shown in FIGS. 3 and 4. Concretely, as shown in FIG. 10, the filter element may have such a structure that an input terminal is connected to an output terminal via a wiring, and a coil and capacitor are connected in series between the wiring and a ground. The input terminal shown in FIG. 10 is connected to the built-in antenna 32, and the output terminal is connected to the matching circuit 24. Furthermore, the transmission element 27 may be constructed by using, in combination, a plurality of filters having structures such as ones shown in FIG. 3(*a*) or FIG. 10. Concretely, the transmission element 27 may be constructed by using two of the filter shown in FIG. 3(*a*) in combination, or the transmission element 27 may also be constructed by using the filter shown in FIG. 3(*a*) in combination with that shown in FIG. 3(*d*). In the present embodiment, the reactive elements of the coil, the capacitor and the like are used in order to construct the transmission element 27 of the filter element. However, the present invention is not limited to this. The transmission element 27 may be constructed of dielectric filters. Further, another example of the configuration of the transmission element 27 constructed of the filter element is a configuration in which the transmission element 27 is formed by a signal line pattern on a FPC (Flexible Printed Circuits), a wiring substrate or the like.

The transmission element 27 included in the wireless device 3 also can be constructed of the switching element constructed of the RF switch, as described in Second Embodiment. In this case, the RF switch included in the wireless device 3 so as to serve as the transmission element 27 is controlled by the control section 40 and the switching control section 41, each of which are described with reference to FIG. 7 in Second Embodiment. Concretely, the control section 40 detects whether or not the system of the built-in antenna 32 is activated, in other words, whether or not the built-in antenna 32 is used, and in accordance with this detected result, the control section 40 switches the RF switch via the switching control section 41. While the built-in antenna 32 is used, the built-in antenna 32 is electrically connected to the radio unit circuit 26 by the RF switch, whereas while the built-in antenna 32 is not used, the built-in antenna 32 is electrically disconnected from the radio unit circuit 26 by the RF switch.

In the present embodiment, the wireless device 3 includes the transmission element 27 between the built-in antenna 32 and the matching circuit 24. However, the wireless device 3 may include the transmission element 27 between the matching circuit 24 and the radio unit circuit 26. This also improves the antenna properties of the casing antenna 11.

Further, in the present embodiment, the transmission element 27 is constructed of the filter element or the RF switch. However, the transmission element 27 may be constructed by using both the filter element and the RF element, in combination.

It is preferable to arrange the wireless device of the present invention such that the coupling section includes a first conductor section connected to the first antenna and a second conductor section connected to the matching section, the first conductor section being electromagnetically coupled to the second conductor section.

According to the foregoing structure, a first conductor section and a second conductor section, which are the coupling sections, are electromagnetically coupled to each other. This makes it possible to dispose the first and the second conductor sections separately from each other. The first conductor section is connected to the first antenna included in the first casing. Therefore, the first conductor section is disposed in the first casing. The second conductor section is connected to the matching section included in the second casing. Therefore, the second conductor section is disposed in the second casing.

When the first casing moves in accordance with the second casing, physical stress given on the coupling section by the movement of the first casing is remarkably reduced in a case where the coupling section includes the first conductor section and the second conductor section that are disposed separately from each other, as compared to a case where the coupling section is made of one conductor. As a result, the wireless device of the present invention having the foregoing structure can further hold down occurrence of poor electrical connection between the first casing and the second casing as compared to a wireless device in which the coupling section is made of one conductor.

As described above, the wireless device of the present invention includes a first casing, housing a first antenna that resonates with a first frequency; a second casing, housing a matching section for matching impedance with that of the first antenna; a joint part, joining the first casing with the second casing, the joint part including a second antenna that resonates with a second frequency different from the first frequency and including a coupling section for electrically coupling the matching section to the first antenna; and a first-frequency transmission element, being disposed on at least any one of a signal path that connects the first antenna and the coupling section and a signal path that connects the matching section and the coupling section, the first-frequency transmission element (i) giving passage to a signal having the first frequency and (ii) blocking a signal having the second frequency.

According to the foregoing structure, a first antenna is coupled to a matching section by a coupling section included in a joint part, and a second antenna is disposed in the joint part. The first antenna is connected to a ground of an upper casing so as to serve as an antenna. Further, the first antenna itself serves as a ground pattern of the upper casing with respect to the second antenna. Furthermore, the matching section for matching impedance with that of the first antenna is connected to a ground of a lower casing. Therefore, the coupling section is connected to two grounds: the ground of the upper casing and the ground of the lower casing.

The wireless device of the present invention has a first-frequency transmission element disposed on any one of (i) a signal path that connects the first antenna and the coupling section and (ii) a signal path that connects the coupling section and the matching section. This first-frequency transmission element blocks a signal having the second frequency with which the second antenna resonates. As a result, the ground around the second antenna is reduced, thereby increasing electrical volume of the second antenna.

For example, in the case where the wireless device has the first-frequency transmission element disposed on the signal path that connects the first antenna and the coupling section, the signal having the second frequency with which the second antenna resonates is not transmitted via the coupling section to the first antenna that is the ground of the upper casing, but is blocked by the first-frequency transmission element. That is, in a second frequency component, the coupling section is disconnected from the ground of the upper casing. Therefore, just the ground of the lower casing is connected to the coupling section. As a result, the coupling section disposed close to the second antenna less serves as a ground, thereby increasing the electrical volume of the second antenna.

Similarly, in the case where the wireless device has the first-frequency transmission element disposed on the signal path that connects the matching section and the coupling section, the coupling section is disconnected from the ground of the lower casing, in the second frequency component. As a result, the coupling section disposed close to the second antenna less serves as a ground, thereby increasing the electrical volume of the second antenna.

Further, in the case where the wireless device has the first-frequency transmission element disposed on both the signal path that connects the first antenna and the coupling section and the signal path that connects the coupling section and the matching section, the coupling section has no connection with the grounds in the second frequency component. As a result, the coupling section disposed close to the second antenna does not serve as a ground at all, thereby causing the electrical volume of the second antenna to be maximized.

The first-frequency transmission element has such a property that the first-frequency transmission element gives passage to the signal having the first frequency with which the first antenna resonates. Therefore, no deterioration occurs to properties of the first antenna, by including the first-frequency transmission element in the wireless device.

As described above, even if both the second antenna and the coupling section are disposed in the joint part, and the second antenna and the coupling section are disposed close to each other, the wireless device of the present invention makes the coupling section disposed close to the second antenna less serve as the ground of the second antenna, and causes the electrical volume of the second antenna to increase. As a result, deterioration in the second antenna properties is reduced, which deterioration is caused by a conductor that serves as a ground being disposed close to the second antenna.

Accordingly, the wireless device of the present invention includes (i) a first antenna disposed in one of two casings and (ii) a second antenna, different from the first antenna, disposed in a joint part where the two casings are joined together, and thus can reduce deterioration in properties of the second antenna included in the joint part.

It is preferable to arrange the wireless device of the present invention such that the first-frequency transmission element is a filter element.

The foregoing structure allows the first-frequency transmission element constructed of the filter element to give passage to the first frequency and to block the second frequency, even if the signal having the first frequency with which the first antenna resonates and the signal having the second frequency with which the second antenna resonates are simultaneously transmitted to the first-frequency transmission element. As a result, deterioration in the properties of the second antenna is reduced in the wireless device, even if the wireless device simultaneously uses two communication systems that have different frequency bands from each other, by using the first antenna and the second antennas simultaneously.

It is preferable to arrange the wireless device of the present invention such that the first-frequency transmission element is a switching element that switches between a coupled state and an uncoupled state of the first antenna and the matching section, based on first-antenna use information and second-antenna use information, the first-antenna use information indicating whether or not the first antenna is used, and the second-antenna use information indicating whether or not the second antenna is used.

The foregoing structure allows the wireless device of the present invention to have the first antenna be uncoupled to the matching section, in a case where the first antenna is not used but the second antenna is used. That is, in a case where a system that uses the second antenna is activated, providing the foregoing structure blocks at least one of electrical connection between the first antenna and the coupling section and electrical connection between the coupling section and the matching section.

As a result, the coupling section less serves as a ground in accordance with the second antenna while the second antenna is used, thereby increasing electrical volume of the second antenna. Hence, deterioration in the properties of the second antenna is reduced.

It is preferable to arrange the wireless device of the present invention such that the second casing includes a signal processing section for processing the signal having the second frequency, the second antenna and the signal processing section being connected via a signal path, the signal path including a second-frequency transmission element that (i) gives passage to the signal having the second frequency and (ii) blocks the signal having the first frequency.

In the wireless device including both the coupling section and the second antenna in the joint part, the coupling section and the second antenna are disposed close to each other. This causes a part of electrical capacitance of the signal having the first frequency, which signal passes through the coupling section, to be transmitted to the second antenna. As a result, a gain of the first antenna is reduced, thereby causing deterioration in the properties of the first antenna.

The foregoing structure allows the wireless device of the present invention to disconnect the second antenna from the signal processing section in a first frequency component, and to shorten electrical length of the second antenna in the first frequency component. As described above, by shortening the electrical length of the second antenna, the electrical capacitance of the high-frequency signal having the first frequency, which electrical capacitance is transmitted to the second antenna from the coupling section is reduced, thereby reducing deterioration in the properties of the first antenna as a result.

It is preferable to arrange the wireless device of the present invention such that the second-frequency transmission element is a filter element.

The foregoing structure allows the second-frequency transmission element constructed of the filter element to give passage to the signal having the second frequency and to block the signal having the first frequency, even if the signal having the first frequency with which the first antenna resonates and the signal having the second frequency with which the second antenna resonates are simultaneously transmitted to the second-frequency transmission element. As a result, the wireless device can still reduce the deterioration in the properties of the first antenna, even if the wireless device simultaneously uses two communication systems that have different frequency bands from each other by using the first antenna and the second antenna simultaneously.

It is preferable to arrange the wireless device of the present invention such that the second-frequency transmission element is a switching element that switches between electrically connecting and electrically disconnecting the second antenna and the signal processing section, based on second-antenna use information indicating whether or not the second antenna is used.

The foregoing structure allows the wireless device of the present invention to electrically disconnect the second antenna from the signal processing section, in a case where the second antenna is not used. This shortens the electrical length of the second antenna while the wireless device does not use the second antenna. As a result, the wireless device of the present invention reduces the deterioration in the properties of the first antenna, in a case where the first antenna is used while the second antenna is not used.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

An object of the present invention is to provide a wireless device, including an antenna in one of two casings and including, in a joint part where the two casings are joined together, another antenna different from the antenna included in the casing, which wireless device is capable of reducing deterioration in properties of the antenna included in the joint part. Particularly, the wireless device of the present invention is applicable to a mobile phone including two antennas that use different frequencies from each other, capable of utilizing a plurality of communication systems, and capable of both utilization of the communication system and reception of airwaves.

REFERENCE SIGNS LIST

1: Wireless Device
1': Wireless Device
1": Wireless Device
2: Wireless Device
3: Wireless Device
10: Upper Casing (First Casing)
11: Casing Antenna (First Antenna)
12: Transmission Element (First-Frequency Transmission Element, Filter Element, Switching Element)
20: Lower Casing (Second Casing)
21: Lower Casing Ground Pattern
22: Transmission Element (First-Frequency Transmission Element, Filter element, Switching Element)
23: Matching Circuit (Matching Section)
26: Radio Unit Circuit (Signal Processing Section)
27: Transmission Element (Second-Frequency Transmission Element, Filter Element, Switching Element)
31: Hinge Part (Joint Part)
32: Built-in Antenna (Second Antenna)
33: Feeding Section (Coupling Section, First Conductor Section)
34: Feeding Section (Coupling Section, Second Conductor Section)

The invention claimed is:

1. A wireless device, comprising
a first casing, housing a first antenna that resonates with a first frequency;
a second casing, housing a matching section for matching impedance with that of the first antenna;
a joint part, joining the first casing with the second casing, the joint part including a second antenna that resonates with a second frequency different from the first frequency and including a coupling section for electrically coupling the matching section to the first antenna;
a first-frequency transmission element, being disposed on at least any one of a signal path that connects the first antenna and the coupling section and a signal path that connects the matching section and the coupling section, the first-frequency transmission element (i) giving passage to a signal having the first frequency and (ii) blocking a signal having the second frequency,
a first signal processing section, connected to the matching section, for processing the signal having the first frequency; and
a second signal processing section, connected to the second antenna, for processing the signal having the second frequency.

2. The wireless device as set forth in claim 1,
wherein:
the coupling section includes:
a first conductor section connected to the first antenna; and
a second conductor section connected to the matching section,
the first conductor section being electromagnetically coupled to the second conductor section.

3. The wireless device as set forth in claim 1,
wherein:
the first-frequency transmission element is a filter element.

4. The wireless device as set forth in claim 2,
wherein:
the first-frequency transmission element is a filter element.

5. The wireless device as set forth in claim 1,
wherein:
the first-frequency transmission element is a switching element that switches between a coupled state and an uncoupled state of the first antenna and the matching section, based on first-antenna use information and second-antenna use information, the first-antenna use information indicating whether or not the first antenna is used, and the second-antenna use information indicating whether or not the second antenna is used.

6. The wireless device as set forth in claim 2, wherein:

the first-frequency transmission element is a switching element that switches between a coupled state and an uncoupled state of the first antenna and the matching section, based on first-antenna use information and second-antenna use information, the first-antenna use information indicating whether or not the first antenna is used, and the second-antenna use information indicating whether or not the second antenna is used.

7. The wireless device as set forth in claim 1, wherein:

the second signal processing section is provided in the second casing, and the second antenna and the second signal processing section being connected via a signal path, the signal path including a second-frequency transmission element that (i) gives passage to the signal having the second frequency and (ii) blocks the signal having the first frequency.

8. The wireless device as set forth in claim 7, wherein:

the second-frequency transmission element is a filter element.

9. The wireless device as set forth in claim 7, wherein:

the second-frequency transmission element is a switching element that switches between electrically connecting and electrically disconnecting the second antenna and the second signal processing section, based on second-antenna use information indicating whether or not the second antenna is used.

10. The wireless device as set forth in claim 1, wherein:

the first antenna and the second antenna are used simultaneously.

* * * * *